US011685630B2

(12) United States Patent
Havens

(10) Patent No.: US 11,685,630 B2
(45) Date of Patent: Jun. 27, 2023

(54) OUTDOOR HOSE STORAGE ENCLOSURE

(71) Applicant: Timothy Robert Havens, Morristown, IN (US)

(72) Inventor: Timothy Robert Havens, Morristown, IN (US)

( * ) Notice: Subject to any disclaimer, the term of this patent is extended or adjusted under 35 U.S.C. 154(b) by 51 days.

(21) Appl. No.: 17/476,394

(22) Filed: Sep. 15, 2021

(65) Prior Publication Data

US 2022/0081250 A1 Mar. 17, 2022

Related U.S. Application Data

(60) Provisional application No. 63/078,781, filed on Sep. 15, 2020.

(51) Int. Cl.
*B65H 75/44* (2006.01)
*F21V 33/00* (2006.01)

(52) U.S. Cl.
CPC ..... *B65H 75/446* (2013.01); *F21V 33/006* (2013.01); *B65H 2701/33* (2013.01)

(58) Field of Classification Search
None
See application file for complete search history.

(56) References Cited

U.S. PATENT DOCUMENTS 501,489 A * 7/1893 Bowers ..... B65H 2701/33
1,599,581 A * 9/1926 Mills ..... B65H 75/4471 242/399.2
1,787,194 A * 12/1930 Freeth ..... B65H 75/4471 242/402
2,696,406 A * 12/1954 Myers ..... B65H 75/4471 137/382
2,802,932 A * 8/1957 Lambert ..... F21V 27/00 362/387
3,183,927 A * 5/1965 Swartz ..... B65H 75/44 16/346

(Continued)

FOREIGN PATENT DOCUMENTS

GB 2 238 038 * 5/1991
KR 10-2379755 * 3/2022

OTHER PUBLICATIONS

Tap safe, Tap-safe.co.uk (https://www.tap-safe.co.uk/specifications.php).

(Continued)

*Primary Examiner* — William A. Rivera

(57) ABSTRACT

An outdoor hose storage enclosure is an apparatus that securely retains a hose and facilitates the deployment and storage of said hose. The apparatus may include a storage housing and a storage lid. The storage housing serves to retain the hose readily accessible for easy retrieval of the hose. The storage lid serves to seal the storage housing to protect the hose from the environment and theft. The storage housing may include a first lateral panel, a second lateral panel, a front panel, a first attachment mechanism, a second attachment mechanism, a bottom panel, and a hose opening. The first lateral panel, the second lateral panel, the front panel, and the bottom panel form the structure of the storage housing. The first attachment mechanism and the second attachment mechanism enable the mounting of the apparatus to the desired surface. The hose opening facilitates the deployment and storage of the hose.

18 Claims, 8 Drawing Sheets

(56) References Cited

U.S. PATENT DOCUMENTS 3,217,738 A * 11/1965 Springsteed ..... A01G 25/00 137/355.2
3,776,262 A * 12/1973 Fritsch ..... B65H 75/364 137/355.16
4,006,948 A * 2/1977 Kessinger ..... A62C 35/20 137/355.16
4,062,493 A * 12/1977 Suggs ..... A62C 35/20 242/395
4,660,782 A * 4/1987 Hegemann ..... B65H 54/2896 242/387
5,526,842 A * 6/1996 Christensen ..... B65H 75/38 137/355.16
5,678,596 A * 10/1997 Corallo ..... B65H 75/4471 137/355.16
5,678,599 A * 10/1997 Moss ..... B65H 75/446 137/355.16
6,467,499 B1 * 10/2002 Smith ..... B65H 75/362 137/355.16
6,550,266 B1 * 4/2003 Miller ..... B65H 75/4471 62/340
7,857,000 B1 * 12/2010 Langdon ..... B65H 75/38 137/355.27
11,462,895 B2 * 10/2022 Otsuba ..... H02G 3/16
2004/0231723 A1 * 11/2004 Harrington ..... A01G 25/162 137/355.2
2009/0071546 A1 * 3/2009 Lawrence ..... B65H 75/4471 137/355.2
2019/0079257 A1 * 3/2019 Daoust ..... G02B 6/445

OTHER PUBLICATIONS

Mayne, Fairfield Garden Hose Bin Black, Walmart, Jul. 2012.
Eagle One Hose Box, Premium Poly Patios (https://www.poly-lumber-furniture.com/eo-hose-box.html).
Garden Hose Hider Woodworking Plan, FamilyHomePlans.
Val Bowman Dodge, Hose Enclosure, Pinterest, 2007.
Amy, DIY Hose Holder with Pallet Wood Planter, DIYCandy, Jun. 2021.
Marsceill, ThermOmegaTech® Releases the Model MRE Washdown Station Enclosure, ThermOmegaTech, Jun. 2017.

* cited by examiner

OUTDOOR HOSE STORAGE ENCLOSURE

The current application claims a priority to the U.S. provisional patent application Ser. No. 63/078,781 filed on Sep. 15, 2020.

FIELD OF THE INVENTION

The present invention generally relates to garden tools and outdoor enclosures. More specifically, the present invention provides an outdoor storage enclosure which securely stores a hose outdoors for quick and easy deployment of the hose.

BACKGROUND OF THE INVENTION

Outdoor hoses are a staple of most homes and businesses with a garden or a lawn. While most outdoor hoses are constructed to be durable and weatherproof, it is always recommended to store the hose properly to extend its durability. For example, a hose left on the ground can be easily damaged by being accidentally stepped on or punctured while performing lawn maintenance. So, various storage devices are currently available to store and protect the hoses outdoors. The storage devices currently available are provided in different shapes and sizes, with different designs, and different functional features. However, few facilitate the deployment of the hose without having to remove the hose from the storage device. Storing and deploying the hose can be a hassle, especially during harsh conditions when the hose has become wet and mudded. Since most of these devices require the user to open the device to retrieve the hose prior to use and manually put the hose back into the device, the user can find the whole process troublesome. Furthermore, parts of the hose are left exposed to the environment, which greatly affects the durability of the hose and can make the use of the hose inconvenient.

Therefore, an objective of the present invention is to provide an outdoor hose storage enclosure designed to store a hose outdoors as well as to cover both the hose and the water valve which the hose is connected to. The present invention can be mounted onto an exterior surface surrounding the water valve to leave the hose connected to the water valve when not in use. Another objective of the present invention is to provide an outdoor hose storage enclosure that facilitates the deployment and storage of the hose without having to open the enclosure. The present invention does not require the user to open the present invention to retrieve the hose and provides means to automatically recoil the hose back into the present invention. Additional features and benefits of the present invention are further discussed in the sections below.

SUMMARY OF THE INVENTION

The present invention is an outdoor hose storage enclosure that retains a hose outdoors in such a way that the hose can be easily retrieved and stored away without the user having to open the present invention. The present invention is designed to protect the hose from different weather conditions as well as from theft. In addition, the present invention facilitates the storage and deployment of the hose, even when the hose is dirty or during harsh conditions. The present invention also enables the easy discharge of any water that may have been collected within the present invention. Furthermore, the present invention can include a laser-cut decorative cut with a desired ornamental design. The interior of the present invention can also be insulated to further protect the stored hose. When ready to use, the user can pull the hose through a side opening of the present invention and turn the water on to use. When finished, the user can turn the water off and the integrated recoiling mechanism will pull the hose back into the present invention. Alternatively, the user can manually pull the hose back into the present invention. The present invention can further include lighting means arranged to illuminate the surroundings or the interior of the present invention when necessary.

DETAIL DESCRIPTIONS OF THE INVENTION

All illustrations of the drawings are for the purpose of describing selected versions of the present invention and are not intended to limit the scope of the present invention.

Figure 1:
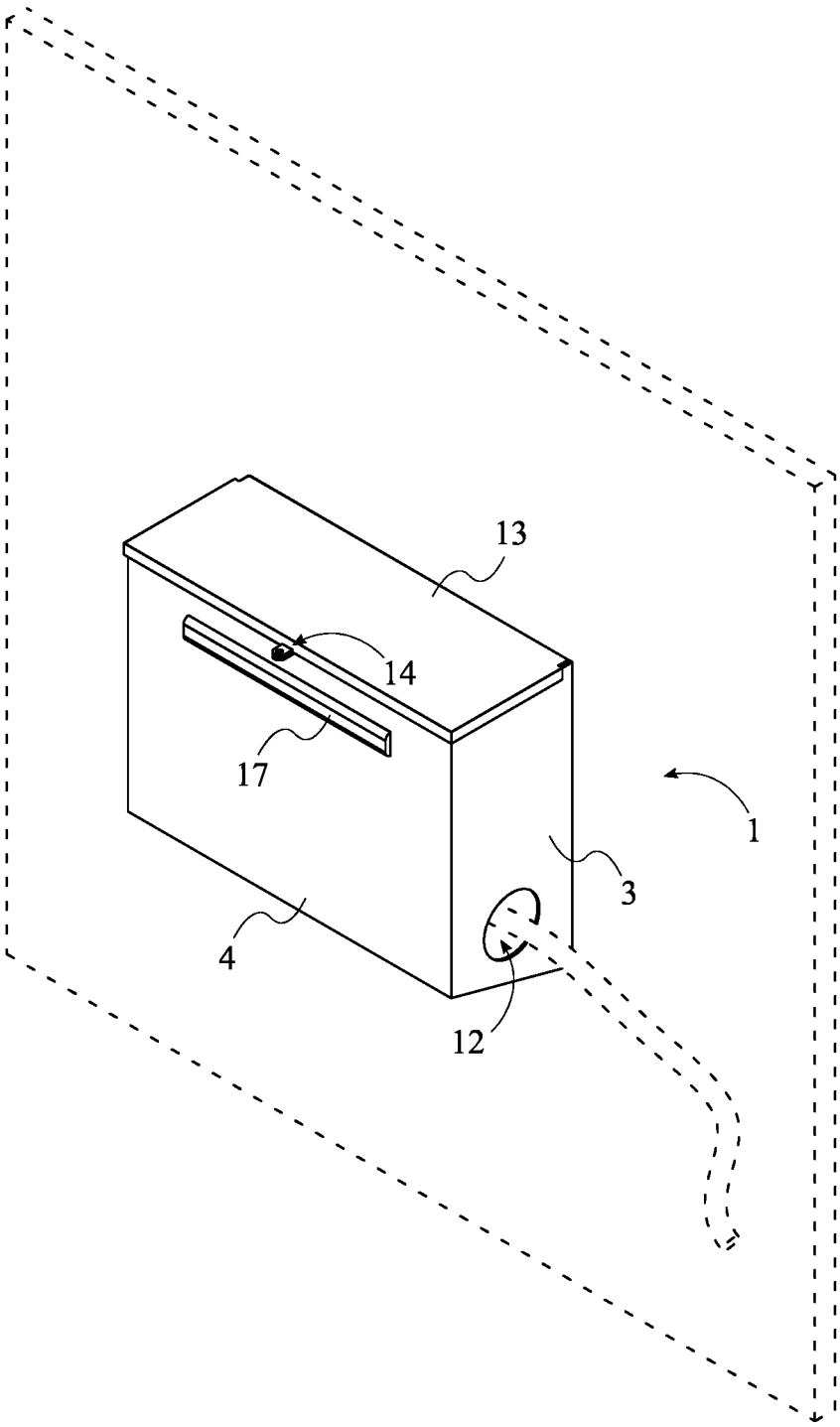
FIG. 1 is a top-front-perspective view showing the present invention, wherein the present invention is shown housing a hose, and wherein the present invention is shown mounted onto a wall.
Figure 2:
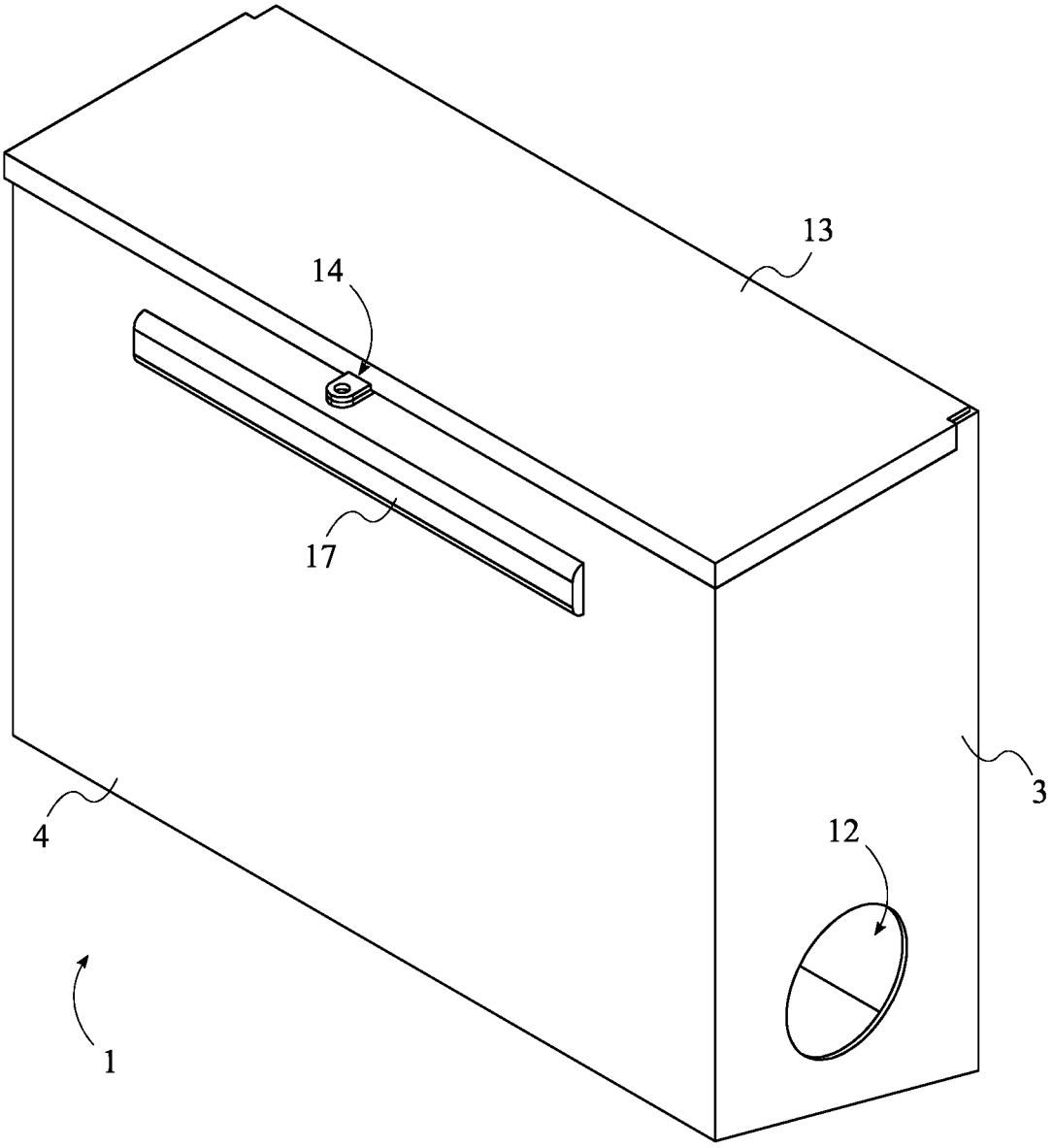
FIG. 2 is a top-front perspective view showing the present invention.
Figure 3:
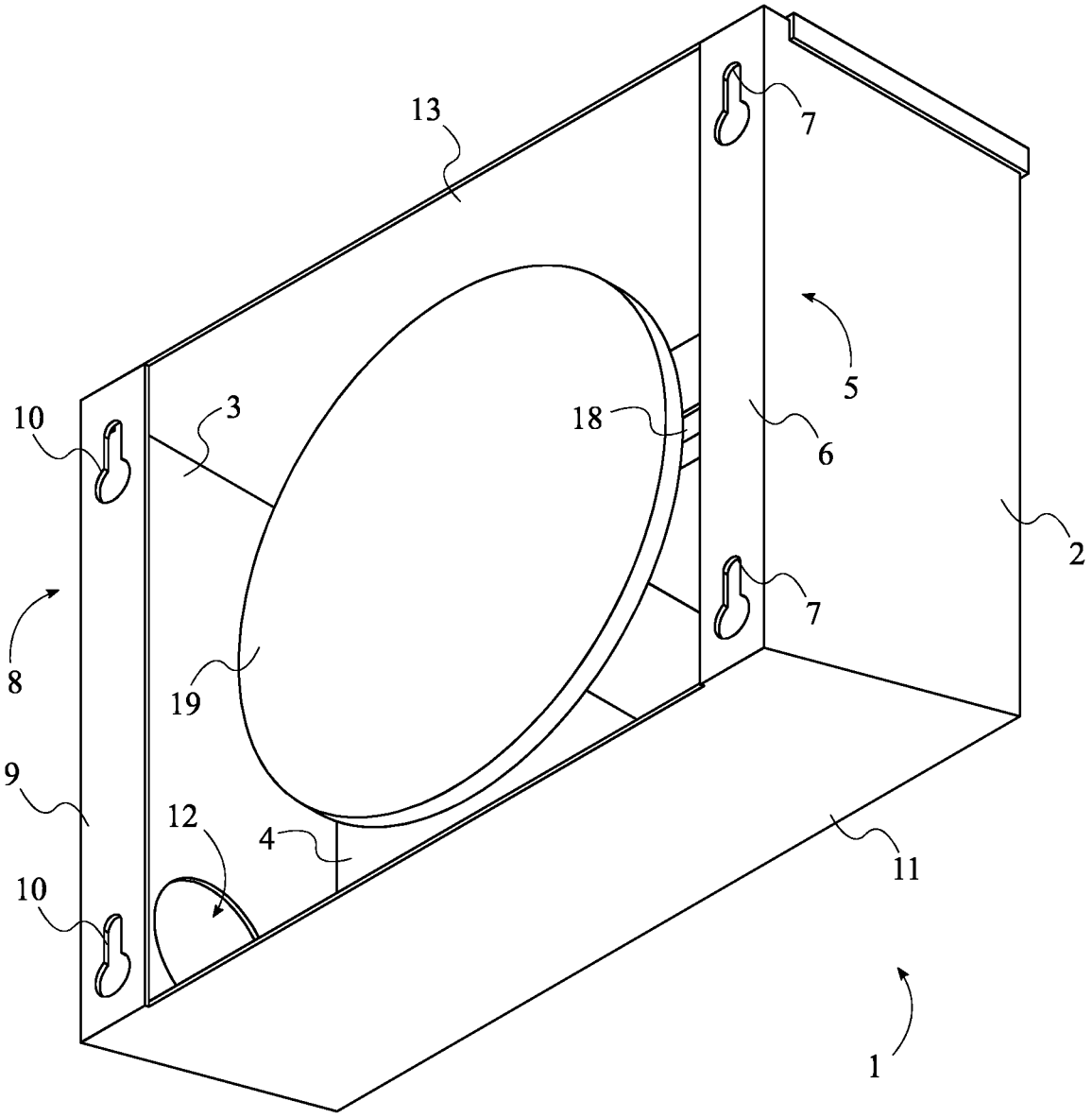
FIG. 3 is a bottom-rear perspective view showing the present invention.

The present invention is an outdoor hose storage enclosure that securely retains a hose and facilitates the deployment and storage of said hose. As can be seen in FIG. 1 through 3, the present invention may comprise a storage housing 1 and a storage lid 13. The storage housing 1 serves to retain the hose in a readily accessible manner so that the user can easily retrieve the hose when needed and store the hose away after the user is done using the hose. The storage lid 13 serves to seal the storage housing 1 to protect the hose from the environment as well as to protect the hose from theft.

The general configuration of the aforementioned components enables users to safely store a hose outdoors while keeping the hose readily available for use. As can be seen in FIG. 1 through 3, the storage housing 1 is a hollow solid structure large enough to retain the hose and spacious enough to facilitate the deployment and storage of the hose without the user having to remove the hose from the storage housing 1. The storage housing 1 comprises a first lateral panel 2, a second lateral panel 3, a front panel 4, a first attachment mechanism 5, a second attachment mechanism 8, a bottom panel 11, and a hose opening 12. The first lateral panel 2, the second lateral panel 3, the front panel 4, and the bottom panel 11 together form the solid structure of the storage housing 1. The first attachment mechanism 5 and the second attachment mechanism 8 enable the mounting of the storage housing 1 to the desired wall or surface. Moreover, both the first attachment mechanism 5 and the second attachment mechanism 8 preferably enable the mounting of the storage housing 1 to an exterior wall or surface. The hose opening 12 facilitates the deployment and storage of the hose when the hose is stored within the storage housing 1. The hose opening 12 preferably has a shape and size large enough to accommodate the diameter of the hose. The hose opening 12 also enables the movement of the hose without damaging the hose as the hose moves through the hose opening 12. Furthermore, the hose opening 12 can be large enough to accommodate hose accessories such as a nozzle connected to the hose.

Figure 4:
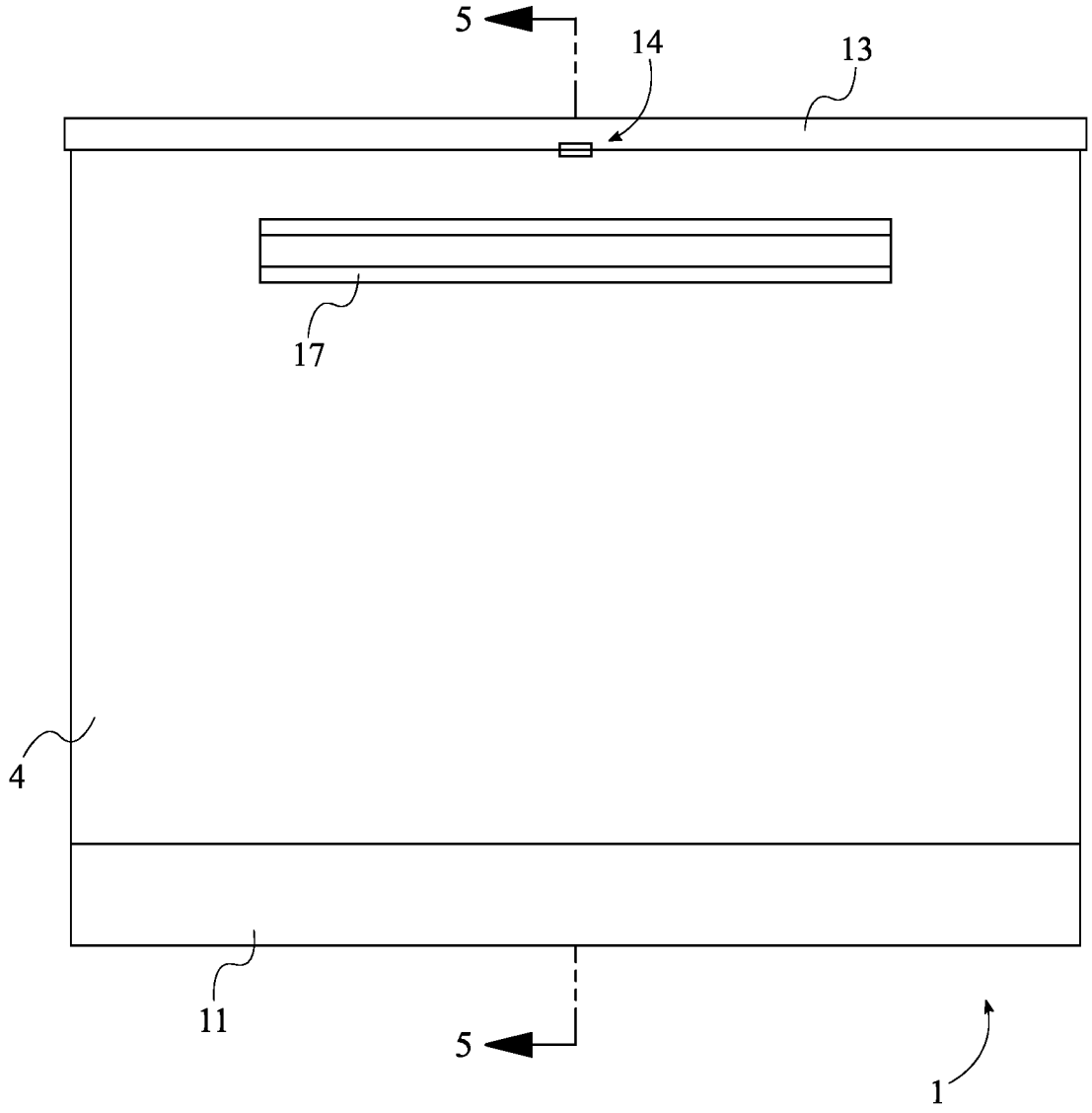
FIG. 4 is a front view showing the present invention.
Figure 5:
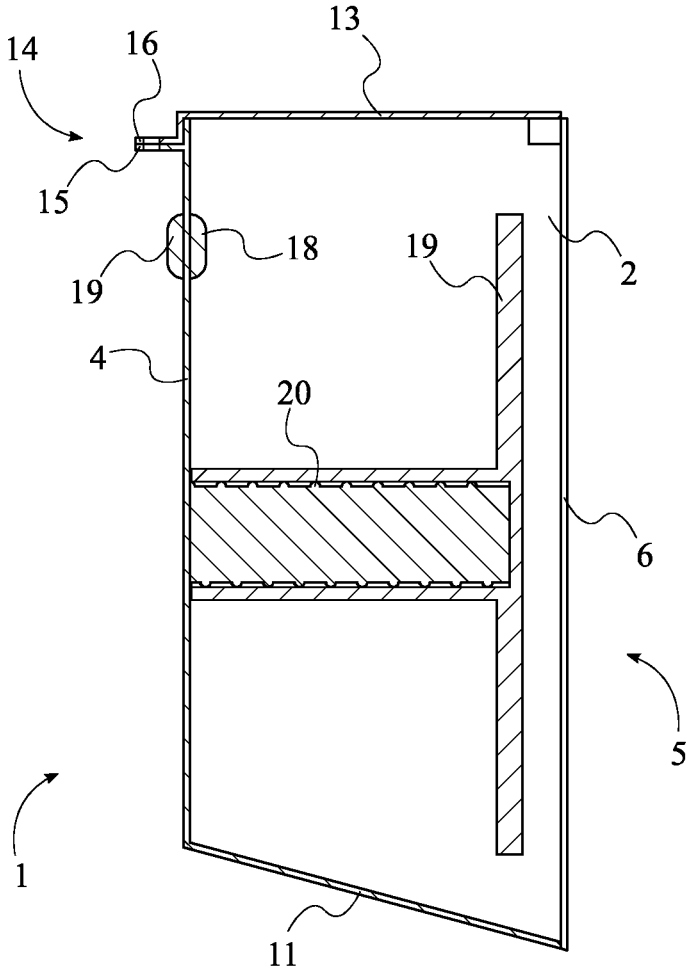
FIG. 5 is a cross-sectional view taken along line 5-5 in FIG. 4.
Figure 6:
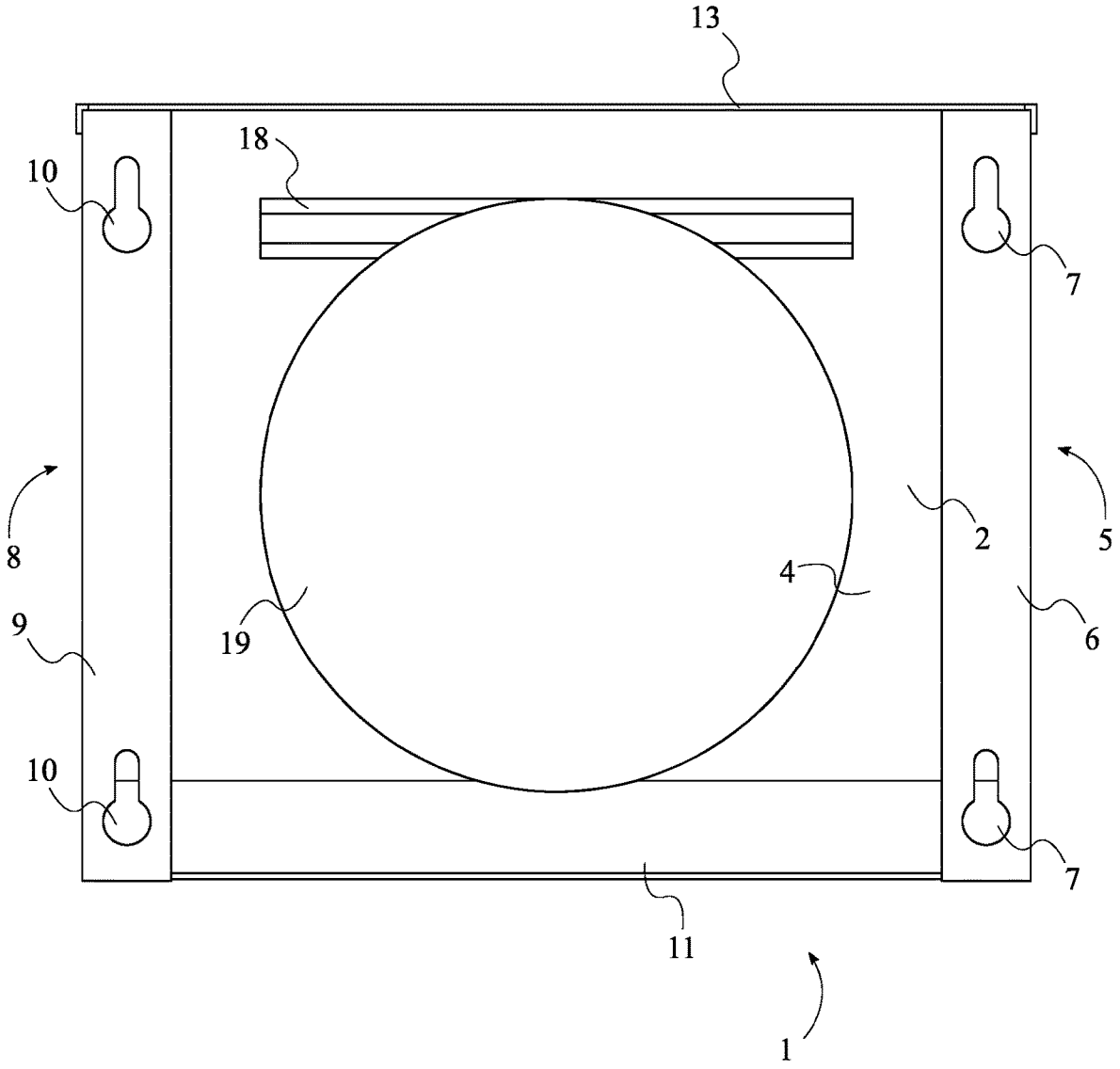
FIG. 6 is a rear view showing the present invention.
Figure 7:
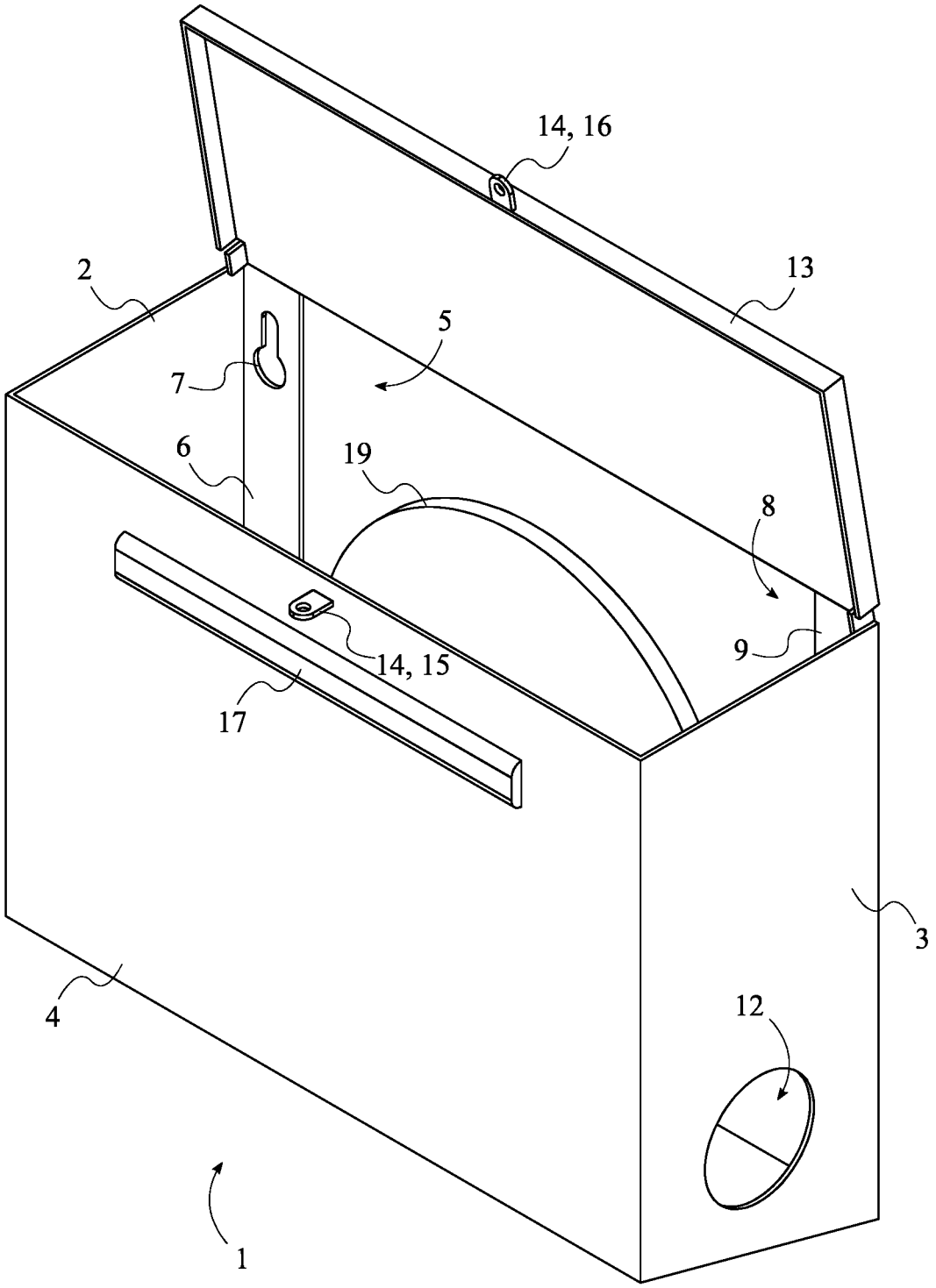
FIG. 7 is a top-front perspective view showing the present invention, wherein the storage lid is shown open.
Figure 8:
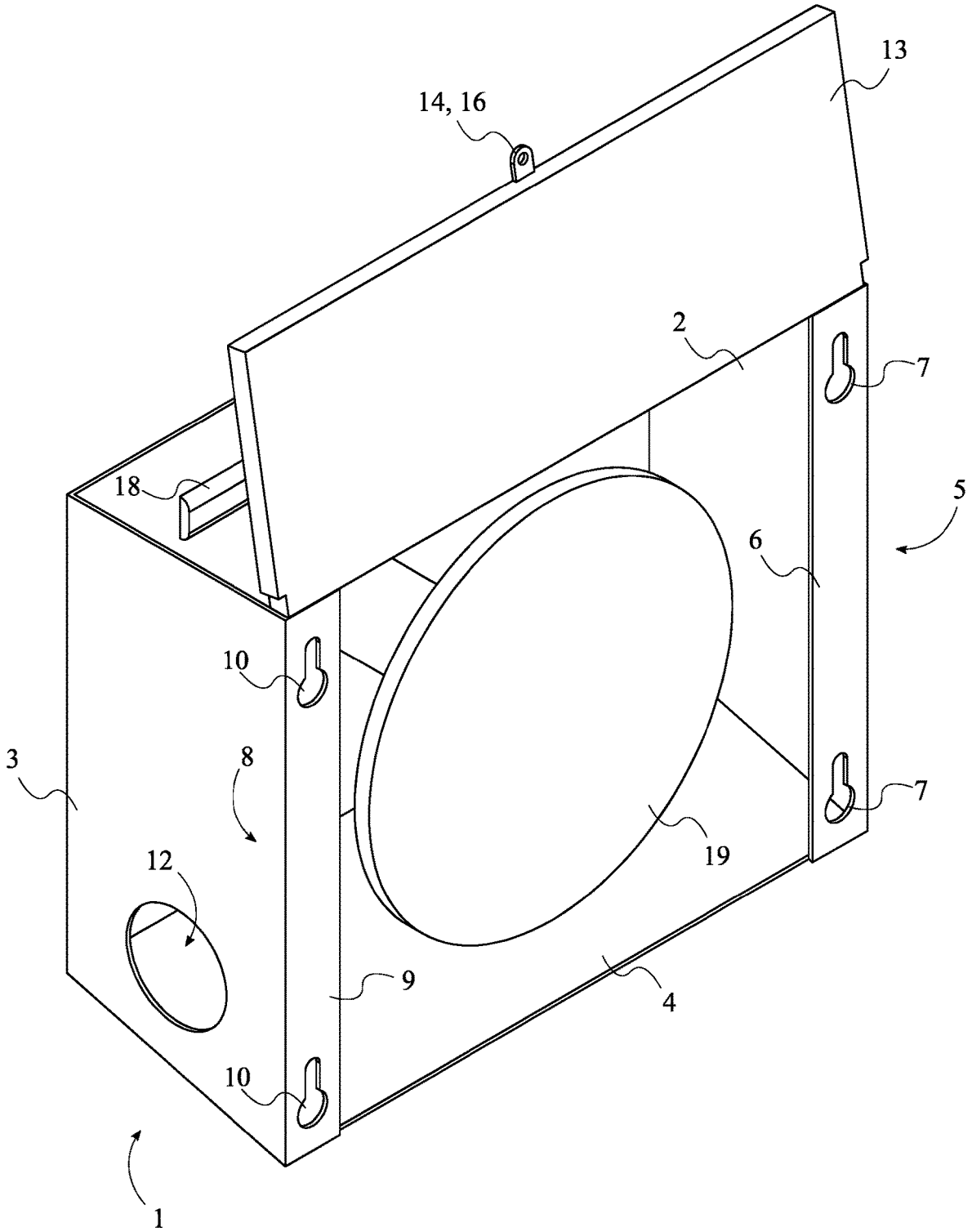
FIG. 8 is a top-rear perspective view showing the present invention, wherein the storage lid is shown open.

As can be seen in FIG. 4 through 6, to form the polygonal solid structure of the storage housing 1, the first lateral panel 2, and the second lateral panel 3 are positioned parallel to each other. The first lateral panel 2 and the second lateral panel 3 preferably correspond to the lateral side panels of the storage housing 1. In addition, the first lateral panel 2 is connected adjacent to the front panel 4. The second lateral panel 3 is also connected adjacent to the front panel 4, opposite to the first lateral panel 2. Thus, the first lateral panel 2, the second lateral panel 3, and the front panel 4 form an overall rectangular structure with an open lateral side, preferably corresponding to the backing of the storage housing 1, and both open bases. Moreover, the first attachment mechanism 5 is connected adjacent to the first lateral panel 2, opposite to the front panel 4. Similarly, the second attachment mechanism 8 is connected adjacent to the second lateral panel 3, opposite to the front panel 4. This arrangement of the first attachment mechanism 5 and the second attachment mechanism 8 enables the storage housing 1 to be mounted onto an exterior wall or surface in such a way that the storage housing 1 is positioned parallel to the exterior wall or surface.

Moreover, the front panel 4, the first lateral panel 2, and the second lateral panel 3 are peripherally connected to the bottom panel 11, as shown in FIG. 4 through 6. This leaves only the base corresponding to the top of the storage housing 1 open. However, to enable the user to close the open base of the storage housing 1, the storage lid 13 is positioned adjacent to the first lateral panel 2 and the second lateral panel 3, opposite the bottom panel 11. The storage lid 13 is also hingedly connected in between the first lateral panel 2 and the second lateral panel 3. This keeps the storage lid 13 always connected to the storage housing 1 while also providing easy access into the storage housing 1. Finally, the hose opening 12 traverses through the second lateral panel 3, adjacent to the bottom panel 11, to provide a secondary access into the storage housing 1 through which the stored hose can be easily retrieved and stored away. In other embodiments, the hose opening 12 may include a valve mechanism which prevents external elements from getting into the storage enclosure without obstructing the deployment and storage of the hose. Further, the hose opening 12 can be repositioned to another location around the storage housing 1. Multiple hose openings can also be provided to accommodate multiple hoses within the storage housing 1.

In one embodiment, the present invention prevents water from accumulating inside the storage housing 1 so that the interior of the storage housing 1 remains dry. So, the bottom panel 11 may be oriented with the front panel 4 at an obtuse angle, as shown in FIG. 4 through 6. This allows for any water getting into the storage housing 1 to flow out through the back of the storage housing 1. Furthermore, in some embodiments, the interior surfaces of the storage housing 1 may be coated in various materials such as insulation material that increases the protection to the hose inside the stored hose. Other materials can include waterproof coating that facilitates the flow of water out of the storage housing 1 to keep the inside of the storage housing 1 as dry as possible. In other embodiments, other coatings can be provided.

As previously discussed, the present invention can be mounted onto an exterior wall or surface to keep the stored hose elevated and readily available. To facilitate the mounting of the present invention to the desired exterior wall or surface, the first attachment mechanism 5 may comprise a first rear strip 6 and a plurality of first fastener holes 7. As can be seen in FIG. 4 through 6, the first rear strip 6 provides a planar surface on which the plurality of first fastener holes 7 can be provided. The plurality of first fastener holes 7 enables the user to utilize different fasteners to secure the storage housing 1 to the exterior wall or surface. The first rear strip 6 is connected adjacent the first lateral panel 2, opposite the front panel 4, to keep the storage housing 1 parallel to the exterior wall or surface. The plurality of first fastener holes 7 is distributed along the first rear strip 6 to distribute the load of the storage housing 1 on the fasteners. In addition, the plurality of first fastener holes 7 traverse through the first rear strip 6 so that the fasteners can be drilled through the first rear strip 6. In one embodiment, each of the plurality of first fastener holes 7 is preferably a keyhole that further facilitates the mounting of the storage housing 1 onto the exterior wall or surface. In other embodiments, the first attachment mechanism 5 can include different means of securing the present invention to an exterior wall or surface.

Similar to the first attachment mechanism 5, the second attachment mechanism 8 may comprise a second rear strip 9 and a plurality of second fastener holes 10. As can be seen in FIG. 4 through 6, the second rear strip 9 provides a planar surface on which the plurality of second fastener holes 10 can be provided. The plurality of second fastener holes 10 enables the user to utilize different fasteners to secure the storage housing 1 to the exterior wall or surface. The second rear strip 9 is connected adjacent the second lateral panel 3, opposite the front panel 4, to keep the storage housing 1 parallel to the exterior wall or surface. The plurality of second fastener holes 10 is distributed along the second rear strip 9 to distribute the load of the storage housing 1 on the fasteners. In addition, the plurality of second fastener holes 10 traverse through the second rear strip 9 so that the fasteners can be drilled through the second rear strip 9. In one embodiment, each of the plurality of second fastener holes 10 is preferably a keyhole that further facilitates the mounting of the storage housing 1 onto the exterior wall or surface. In other embodiments, the second attachment mechanism 8 can include different means of securing the present invention to an exterior wall or surface.

To prevent theft of the hose and to keep the storage lid 13 closed when not in use, the present invention may further comprise a lid-locking mechanism 14. As can be seen in FIGS. 1, 2, 3, 7, and 8, the lid-locking mechanism 14 enables the user to keep the present invention closed so that the hose can be kept outdoors without worrying of the hose getting stolen. The lid-locking mechanism 14 comprises a first locking piece 15 and a second locking piece 16. The first locking piece 15 and the second locking piece 16 preferably correspond to matching pieces that can be locked together using an external lock. The first locking piece 15 is preferably connected onto the front panel 4, while the second locking piece 16 is connected onto the storage lid 13. Further, the first locking piece 15 and the second locking piece 16 are arranged in such a way that the first locking piece 15 is positioned adjacent to the second locking piece 16 when the storage lid 13 is closed. Thus, to lock the storage lid 13 to the storage housing 1, the first locking piece 15 is operatively coupled to the second locking piece 16, wherein the first locking piece 15 and the second locking piece 16 are used to selectively lock the storage lid 13 onto the storage housing 1. For example, the first locking piece 15 and the second locking piece 16 can each be a perforated tab. The perforated tabs can be arranged so that when positioned together, an external lock can be used to lock both perforated tabs together. In alternate embodiments, the lid-locking mechanism 14 can utilize different means to lock the storage lid 13 closed.

In some embodiments, the present invention can include means to illuminate the surroundings so that the user can locate the present invention in the dark or for ornamental purposes. So, the present invention may further comprise a first outdoor illumination system 17. As can be seen in FIG. 4 through 8, the first outdoor illumination system 17 is externally mounted to the storage housing 1 so that the surroundings of the storage housing 1 are illuminated by the first outdoor illumination system 17. The present invention may further comprise a second outdoor illumination system 18 that illuminates the interior of the storage housing 1. So, the second outdoor illumination system 18 is mounted within the storage housing 1 to illuminate the interior of the storage housing 1. Both the first outdoor illumination system 17 and the second outdoor illumination system 18 may include at least one light source, a controller to help the user selectively engage the first outdoor illumination system 17 and/or the second outdoor illumination system 18, and a power system to provide the voltage necessary for the operation of the at least one light source. Both the controller and the power system may be mounted within the housing to protect the electronics from the weather. Furthermore, the controller can enable the manual operation of the first outdoor illumination system 17 and/or the second outdoor illumination system 18, or the user can configure the controller to operate automatically under predetermined settings. For example, the light sources can be configured to activate after sunset and deactivate after sunrise. Further, the power system may include internal power storage devices which can be recharged or replaced. Alternatively, the power system can be wired to an external power source to power up the light sources.

Furthermore, to facilitate the deployment and storage of the hose, the present invention may further comprise a hose spool 19. As can be seen in FIG. 4 through 8, the hose spool 19 enables the quick deployment and storage of the hose without damaging the hose. The hose spool 19 is rotatably mounted within the storage housing 1 so that the hose is retained inside the storage housing 1. In addition, the hose spool 19 enables the user to easily retrieve the hose by pulling the hose out of the storage housing 1 through the hose opening 12. The hose spool 19 rotates as the hose is being pulled out of the storage housing 1 to prevent damage to the hose. To store the hose away, the user can manually rotate the hose spool 19 to pull the hose back into the storage housing 1 without damaging the hose by opening the storage lid 13 and rotating the hose spool 19. In another embodiment, the present invention may include means for automatic storage of the hose without manual effort nor having to open the storage lid 13. So, the present invention may further comprise a recoiling mechanism 20 designed to automatically rotate the hose spool 19 when the user wants to store the hose away. The recoiling mechanism 20 is operatively integrated between the hose spool 19 and the storage housing 1, wherein the recoiling mechanism 20 is used to reverse rotation of the hose spool 19. For example, the recoiling mechanism 20 can include a spring assembly with an automatic lock integrated into the hose spool 19. This enables the user to pull out the hose and lock the recoiling mechanism 20 to prevent the hose from being recoiled back into the storage housing 1 while the hose is being used. However, the user can disengage the lock, either with a pull or similar remote trigger, and let the hose be pulled back into the storage housing 1. In other embodiments, the recoiling mechanism 20 can utilize other mechanisms that do not utilize springs.

Although the invention has been explained in relation to its preferred embodiment, it is to be understood that many other possible modifications and variations can be made without departing from the spirit and scope of the invention.

What is claimed is:

1. An outdoor hose storage enclosure comprising:

a storage housing;

a storage lid;

the storage housing comprising a first lateral panel, a second lateral panel, a front panel, a first attachment mechanism, a second attachment mechanism, a bottom panel, and a hose opening;

the first lateral panel and the second lateral panel being positioned parallel to each other;

the first lateral panel being connected adjacent to the front panel;

the second lateral panel being connected adjacent to the front panel, opposite to the first lateral panel;

the first attachment mechanism being connected adjacent to the first lateral panel, opposite to the front panel;

the second attachment mechanism being connected adjacent to the second lateral panel, opposite to the front panel;

the first attachment mechanism and the second attachment mechanism being two physically separate objects;

the first attachment mechanism and the second attachment mechanism being positioned offset and parallel to each other;

the front panel, the first lateral panel, and the second lateral panel being peripherally connected to the bottom panel;

the storage lid being positioned adjacent to the first lateral panel and the second lateral panel, opposite the bottom panel;

the storage lid being hingedly connected in between the first lateral panel and the second lateral panel; and, the hose opening traversing through the second lateral panel, adjacent to the bottom panel.

2. The outdoor hose storage enclosure as claimed in claim 1, wherein the bottom panel is oriented with the front panel at an obtuse angle.

3. The outdoor hose storage enclosure as claimed in claim 1 comprising:

the first attachment mechanism comprising a first rear strip and a plurality of first fastener holes;

the first rear strip being connected adjacent the first lateral panel, opposite the front panel;

the plurality of first fastener holes being distributed along the first rear strip;

the plurality of first fastener holes traversing through the first rear strip;

each of the plurality of first fastener holes being a hanging keyhole shape;

a narrow portion of the hanging keyhole shape being oriented away from the bottom panel; and, a wider portion of the hanging keyhole shape being oriented towards the bottom panel.

4. The outdoor hose storage enclosure as claimed in claim 1 comprising:

the second attachment mechanism comprising a second rear strip and a plurality of second fastener holes;

the second rear strip being connected adjacent the second lateral panel, opposite the front panel;

the plurality of second fastener holes being distributed along the second rear strip;

the plurality of second fastener holes traversing through the second rear strip;

each of the plurality of second fastener holes being a hanging keyhole shape;

a narrow portion of the hanging keyhole shape being oriented away from the bottom panel; and, a wider portion of the hanging keyhole shape being oriented towards the bottom panel.

5. The outdoor hose storage enclosure as claimed in claim 1 comprising:

a lid-locking mechanism;

the lid-locking mechanism comprising a first locking piece and a second locking piece;

the first locking piece being connected onto the front panel;

the second locking piece being connected onto the storage lid;

the first locking piece and the second locking piece being a pair of perforated tabs;

the first locking piece and the second locking piece being externally positioned to the storage housing;

the first locking piece and the second locking piece being positioned perpendicular to the front panel; and, the first locking piece being operatively coupled to the second locking piece, wherein the first locking piece and the second locking piece are used to selectively lock the storage lid onto the storage housing.

6. The outdoor hose storage enclosure as claimed in claim 1 comprising:

a first outdoor illumination system; and, the first outdoor illumination system being externally mounted to the storage housing.

7. The outdoor hose storage enclosure as claimed in claim 1 comprising:

a second outdoor illumination system; and, the second outdoor illumination system being mounted within the storage housing.

8. The outdoor hose storage enclosure as claimed in claim 1 comprising:

a hose spool; and, the hose spool being rotatably mounted within the storage housing.

9. The outdoor hose storage enclosure as claimed in claim 8 comprising:

a recoiling mechanism; and, the recoiling mechanism being operatively integrated between the hose spool and the storage housing, wherein the recoiling mechanism is used to reverse rotation of the hose spool.

10. An outdoor hose storage enclosure comprising:

a storage housing;

a storage lid;

a first outdoor illumination system;

a second outdoor illumination system;

the storage housing comprising a first lateral panel, a second lateral panel, a front panel, a first attachment mechanism, a second attachment mechanism, a bottom panel, and a hose opening;

the first lateral panel and the second lateral panel being positioned parallel to each other;

the first lateral panel being connected adjacent to the front panel;

the second lateral panel being connected adjacent to the front panel, opposite to the first lateral panel;

the first attachment mechanism being connected adjacent to the first lateral panel, opposite to the front panel;

the second attachment mechanism being connected adjacent to the second lateral panel, opposite to the front panel;

the first attachment mechanism and the second attachment mechanism being two physically separate objects;

the first attachment mechanism and the second attachment mechanism being positioned offset and parallel to each other;

the front panel, the first lateral panel, and the second lateral panel being peripherally connected to the bottom panel;

the storage lid being positioned adjacent to the first lateral panel and the second lateral panel, opposite the bottom panel;

the storage lid being hingedly connected in between the first lateral panel and the second lateral panel;

the hose opening traversing through the second lateral panel, adjacent to the bottom panel;

the bottom panel being oriented with the front panel at an obtuse angle;

the first outdoor illumination system being externally mounted to the storage housing; and, the second outdoor illumination system being mounted within the storage housing.

11. The outdoor hose storage enclosure as claimed in claim 10 comprising:

the first attachment mechanism comprising a first rear strip and a plurality of first fastener holes;

the first rear strip being connected adjacent the first lateral panel, opposite the front panel;

the plurality of first fastener holes being distributed along the first rear strip;

the plurality of first fastener holes traversing through the first rear strip;

each of the plurality of first fastener holes being a hanging keyhole shape;

a narrow portion of the hanging keyhole shape being oriented away from the bottom panel; and, a wider portion of the hanging keyhole shape being oriented towards the bottom panel.

12. The outdoor hose storage enclosure as claimed in claim 10 comprising:

the second attachment mechanism comprising a second rear strip and a plurality of second fastener holes;

the second rear strip being connected adjacent the second lateral panel, opposite the front panel;

the plurality of second fastener holes being distributed along the second rear strip;

the plurality of second fastener holes traversing through the second rear strip;

each of the plurality of second fastener holes being a hanging keyhole shape;

a narrow portion of the hanging keyhole shape being oriented away from the bottom panel; and, a wider portion of the hanging keyhole shape being oriented towards the bottom panel.

13. The outdoor hose storage enclosure as claimed in claim 10 comprising:

a lid-locking mechanism;

the first locking piece being connected onto the front panel;

the second locking piece being connected onto the storage lid;

the first locking piece and the second locking piece being a pair of perforated tabs;

the first locking piece and the second locking piece being externally positioned to the storage housing;

the first locking piece and the second locking piece being positioned perpendicular to the front panel; and, the first locking piece being operatively coupled to the second locking piece, wherein the first locking piece and the second locking piece are used to selectively lock the storage lid onto the storage housing.

14. The outdoor hose storage enclosure as claimed in claim 10 comprising:

a hose spool;

a recoiling mechanism;

the hose spool being rotatably mounted within the storage housing; and, the recoiling mechanism being operatively integrated between the hose spool and the storage housing, wherein the recoiling mechanism is used to reverse rotation of the hose spool.

15. An outdoor hose storage enclosure comprising:

a storage housing;

a storage lid;

a lid-locking mechanism;

a first outdoor illumination system;

a second outdoor illumination system;

the storage housing comprising a first lateral panel, a second lateral panel, a front panel, a first attachment mechanism, a second attachment mechanism, a bottom panel, and a hose opening;

the lid-locking mechanism comprising a first locking piece and a second locking piece;

the first lateral panel and the second lateral panel being positioned parallel to each other;

the first lateral panel being connected adjacent to the front panel;

the second lateral panel being connected adjacent to the front panel, opposite to the first lateral panel;

the first attachment mechanism being connected adjacent to the first lateral panel, opposite to the front panel;

the second attachment mechanism being connected adjacent to the second lateral panel, opposite to the front panel;

the first attachment mechanism and the second attachment mechanism being two physically separate objects;

the first attachment mechanism and the second attachment mechanism being positioned offset and parallel to each other;

the front panel, the first lateral panel, and the second lateral panel being peripherally connected to the bottom panel;

the storage lid being positioned adjacent to the first lateral panel and the second lateral panel, opposite the bottom panel;

the storage lid being hingedly connected in between the first lateral panel and the second lateral panel;

the hose opening traversing through the second lateral panel, adjacent to the bottom panel;

the bottom panel being oriented with the front panel at an obtuse angle;

the first locking piece being connected onto the front panel;

the second locking piece being connected onto the storage lid;

the first locking piece and the second locking piece being a pair of perforated tabs;

the first locking piece and the second locking piece being externally positioned to the storage housing;

the first locking piece and the second locking piece being positioned perpendicular to the front panel;

the first locking piece being operatively coupled to the second locking piece, wherein the first locking piece and the second locking piece are used to selectively lock the storage lid onto the storage housing;

the first outdoor illumination system being externally mounted to the storage housing; and, the second outdoor illumination system being mounted within the storage housing.

16. The outdoor hose storage enclosure as claimed in claim 15 comprising:

the first attachment mechanism comprising a first rear strip and a plurality of first fastener holes;

the first rear strip being connected adjacent the first lateral panel, opposite the front panel;

the plurality of first fastener holes being distributed along the first rear strip;

the plurality of first fastener holes traversing through the first rear each of the plurality of first fastener holes being a hanging keyhole shape;

a narrow portion of the hanging keyhole shape being oriented away from the bottom panel; and, a wider portion of the hanging keyhole shape being oriented towards the bottom panel.

17. The outdoor hose storage enclosure as claimed in claim 15 comprising:

the second attachment mechanism comprising a second rear strip and a plurality of second fastener holes;

the second rear strip being connected adjacent the second lateral panel, opposite the front panel;

the plurality of second fastener holes being distributed along the second rear strip;

the plurality of second fastener holes traversing through the second rear strip;

each of the plurality of second fastener holes being a hanging keyhole shape;

a narrow portion of the hanging keyhole shape being oriented away from the bottom panel; and, a wider portion of the hanging keyhole shape being oriented towards the bottom panel.

18. The outdoor hose storage enclosure as claimed in claim 15 comprising:

a hose spool;

a recoiling mechanism;

the hose spool being rotatably mounted within the storage housing; and, the recoiling mechanism being operatively integrated between the hose spool and the storage housing, wherein the recoiling mechanism is used to reverse rotation of the hose spool.

* * * * *